US005796211A

United States Patent [19]

Graebner et al.

[11] Patent Number: 5,796,211

[45] Date of Patent: Aug. 18, 1998

[54] MICROWAVE VACUUM TUBE DEVICES EMPLOYING ELECTRON SOURCES COMPRISING ACTIVATED ULTRAFINE DIAMONDS

[75] Inventors: John Edwin Graebner, Short Hills; Sungho Jin, Millington; Gregory Peter Kochanski, Dunellen; Wei Zhu, Middlesex, all of N.J.

[73] Assignee: Lucent Technologies, Inc., Murray Hill, N.J.

[21] Appl. No.: 640,592

[22] Filed: May 1, 1996

Related U.S. Application Data

[63] Continuation-in-part of Ser. No. 381,375, Jan. 31, 1995, Pat. No. 5,616,368, and Ser. No. 361,616, Dec. 22, 1994, Pat. No. 5,709,577.

[51] Int. Cl.[6] ..... H01J 23/04

[52] U.S. Cl. ..... 315/3.5; 313/311; 313/336

[58] Field of Search ..... 315/3.5; 313/309, 313/310, 311, 336, 351

[56] References Cited

U.S. PATENT DOCUMENTS

| | | | |
|---|---|---|---|
| 4,807,355 | 2/1989 | Harper | 315/3.5 X |
| 5,124,664 | 6/1992 | Cade et al. | 315/3.5 |
| 5,155,412 | 10/1992 | Chang et al. | 313/336 |
| 5,604,401 | 2/1997 | Makishima | 315/3 |
| 5,623,180 | 4/1997 | Jin et al. | 313/310 |
| 5,637,950 | 6/1997 | Jin et al. | 313/310 |
| 5,648,699 | 7/1997 | Jin et al. | 313/309 |

*Primary Examiner*—Robert Pascal
*Assistant Examiner*—Justin P. Bettendorf

[57] ABSTRACT

In accordance with the invention, a microwave vacuum tube device, such as a traveling wave tube, is provided with an electron source comprising activated ultrafine diamonds. Applicants have discovered that ultrafine diamonds (5–1,000 nm diameter), when activated by heat treatment in a hydrogen plasma, become excellent room-temperature electron emitters capable of producing electron emission current density of at least 10 mA/cm$^2$ at low electric fields of 10 V/micrometer. Sources using these diamonds provide electrons for microwave vacuum tubes at low voltage, low operating temperature and with fast turn-on characteristics. A multiple grid structure is described for providing high quality electron beams particularly useful for traveling wave tubes.

26 Claims, 6 Drawing Sheets

MICROWAVE VACUUM TUBE DEVICES EMPLOYING ELECTRON SOURCES COMPRISING ACTIVATED ULTRAFINE DIAMONDS

CROSS REFERENCES TO RELATED APPLICATIONS

This application is a continuation-in-part of U.S. patent application Ser. No. 08/381,375 filed Jan. 31, 1995, now U.S. Pat. No. 5,616,368, in the name of Sungho Jin et al. and entitled "FIELD EMISSION DEVICES EMPLOYING ACTIVATED DIAMOND PARTICLE EMITTERS AND METHODS FOR MAKING THE SAME". It is also a continuation-in-part of U.S. patent application Ser. No. 08/361,616, now U.S. Pat. No. 5,709,577, filed by Jin et al. on Dec. 22, 1994.

FIELD OF THE INVENTION

This invention pertains to microwave vacuum tube devices, such as traveling wave tubes, and, in particular, to improved microwave vacuum tube devices employing electron sources comprising activated ultrafine diamonds.

BACKGROUND OF THE INVENTION

Microwave vacuum tube devices, such as power amplifiers, are essential components of many modern microwave systems including telecommunications, radar, electronic warfare, and navigation systems. While semiconductor microwave amplifiers are available, they generally lack the power capabilities required by most microwave systems. Microwave tube amplifiers, in contrast, can provide microwave energy at levels of power higher by orders of magnitude. The higher power levels of tube devices are the result of the fact that electrons can travel at a much higher velocity in a vacuum than they can travel in a semiconductor. The higher speed permits use of larger structures with the same transit time. Larger structures, in turn, permit greater power levels.

Microwave tube devices typically operate by introducing a beam of electrons into a region where it will interact with an input signal and deriving an output signal from the thus-modulated electron beam. See A. W. Scott, *Understanding Microwaves,* Ch. 12 (John Wiley & Sons, Inc., 1993) which is incorporated herein by reference. Microwave tube devices include traveling wave tubes, gridded tubes, klystrons, cross-field amplifiers and gyrotrons. All require a source of electrons.

The usual source of electrons for microwave tube devices is the thermionic emission cathode. Tungsten cathodes, which may be coated with barium oxide or mixed with thorium oxide, are heated to a temperature in the vicinity of 1000° C. to produce appreciable thermionic electron emission on the order of amperes per square centimeter.

The necessity of heating thermionic cathodes causes a number of problems: it limits their lifetimes, introduces warm-up delays, and requires bulky ancillary equipment. Limited lifetime is a consequence of the high operating temperatures. Key constituents of the cathode, such as barium oxide, evaporate from the hot surface. When the barium is depleted, the cathode (and hence the tube) can no longer perform. Many traveling wave tubes (TWTs), for example, have operating lives of less than a year. A second disadvantage is the delay in emission from the thermionic cathodes. Delays up to four minutes have been experienced, even after a cathode reaches its desired temperature. This length of delay is unacceptable in fast-warm-up applications. Third, the high temperature operation requires a peripheral cooling system such as a fan, increasing the size of the device or the system in which it is employed. Accordingly, there is a need for an improved electron source for microwave tube devices which does not require high temperature heating.

SUMMARY OF THE INVENTION

In accordance with the invention, a microwave vacuum tube device, such as a traveling wave tube, is provided with an electron source comprising activated ultrafine diamonds. Applicants have discovered that ultrafine diamonds (5–1,000 nm diameter), when activated by heat treatment in a hydrogen plasma, become excellent room-temperature electron emitters capable of producing electron emission current density of at least 10 mA/cm$^2$ at low electric fields of 10 V/micrometer. Sources using these diamonds provide electrons for microwave vacuum tubes at low voltage, low operating temperature and with fast turn-on characteristics. A multiple grid structure is described for providing high quality electron beams particularly useful for traveling wave tubes.

BRIEF DESCRIPTION OF THE DRAWINGS

The nature, advantages and various additional features of the invention will appear more fully upon consideration of the illustrative embodiments now to be described in detail in connection with the accompanying drawings. In the drawings.

It is to be understood that the drawings are for purposes of illustrating the concepts of the invention and, except for graphical illustrations, are not to scale.

DETAILED DESCRIPTION

This description is divided into three parts: Part I describes an exemplary conventional microwave vacuum tube device—here a TWT—in which electron sources comprising activated ultrafine diamonds can be employed. Part II describes how to make such sources and use them in microwave tube devices, and Part III describes a preferred electron source for providing high quality electron beams particularly useful for TWTS.

I. An Exeinplary TWT

Figure 1:
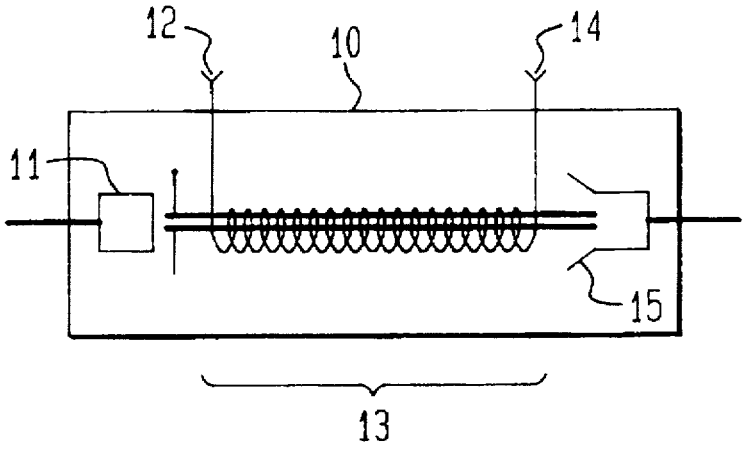
FIG. 1 (PRIOR ART)
FIG. 1 schematically depicts an exemplary TWT structure.

Referring to the drawings, FIG. 1 is a schematic cross section of a conventional microwave vacuum tube device—here a TWT—comprising an evacuated tube 10, a source of electrons in the form of an electron gun 11, an input window 12 for introducing a microwave input signal, an interaction structure 13 where the electrons interact with the input signal, and a microwave output window 14 where microwave power derived from the electrons is taken out of the tube. In the case of a TWT, other components include a focusing magnet (not shown) to focus the beam of electrons through the interaction structure 13, a collector 15 to collect the electron beam after the output microwave power has been generated and an internal attenuator (not shown) to absorb microwave power reflected back into the tube from mismatches in the output. For a TWT the interaction region 13 can be a conductive helix for broadband applications or a coupled-cavity region for high power applications.

Figure 2:
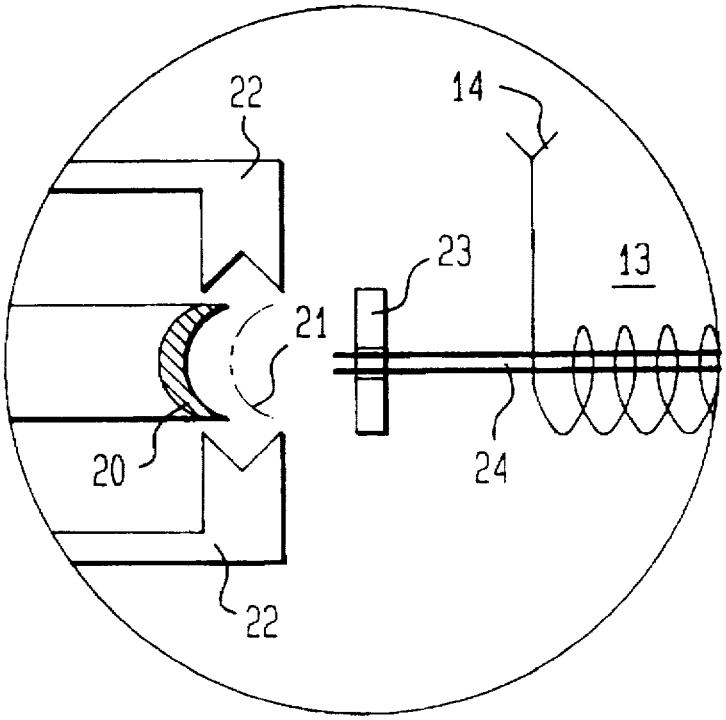
FIG. 2 (PRIOR ART)
FIG. 2 is an enlarged view of the electron gun structure for the TWT of FIG. 1.

The electron gun 11 is a particular kind of electron source which generates, accelerates and focuses an electron beam to follow a desired trajectory after it leaves the gun. FIG. 2 schematically illustrates a typical conventional electron gun comprising a thermionic cathode 20, one or more grids 21 for inducing emission of electrons, focusing electrodes 22 for focusing the electrons into a beam, and apertured anode 23 for further directing the beam 24 into interaction structure 13. For TWT applications, a long, thin electron beam at relatively low voltage and high current density is desirable. Electron guns can range in configuration from a planar cathode faced by a planar anode to more elaborate designs such as Pierce guns, conical diode electrodes, concentric cylinders or spherical cap cathodes.

In operation of the FIG. 1 and FIG. 2 device, an electron beam 24 is accelerated from cathode 20 by high voltages applied to grids 21 and anode 23. The electron beam is then shot into the interaction structure 13 where it interacts with the microwave input signal to be amplified as the electrons and the signal travel together through the interaction structure. In a TWT the electrons desirably travel at the same velocity as the microwave signal on the interaction structure. The power of the input signal modulates the electron beam, and the modulated electron beam generates an amplified form of the input signal at the out-put 14.

II. Electron Sources Comprising Activated Ultrafine Diamonds

The cathode (20 of FIG. 2) and grid 21 are the source of electrons for the electron beam in the TWT of FIG. 1. An ideal cathode would have the following properties and capabilities:

(1) It should have a low work function so that its surface can emit electrons freely without the necessity of external excitation such as heating or bombardment.

(2) It should be capable of supplying a high current density.

(3) It should have a long operating life with its electron emission continuing substantially unimpaired.

(4) It should allow the production of a narrow beam with a small spread in electron momentum; and (5) It should allow production of a modulated electron beam at or near the cathode.

Applicants have discovered that cold (unheated) cathodes comprising activated ultrafine diamonds more closely approach these ideals than conventional thermionic cathodes. The new cold cathodes are capable of fast, room-temperature emission when an electric field is applied. They allow the production of a modulated electron beam over a distance of a few microns, permitting the use of a foreshortened interaction region and resulting in a lighter, more compact device.

Figure 3:
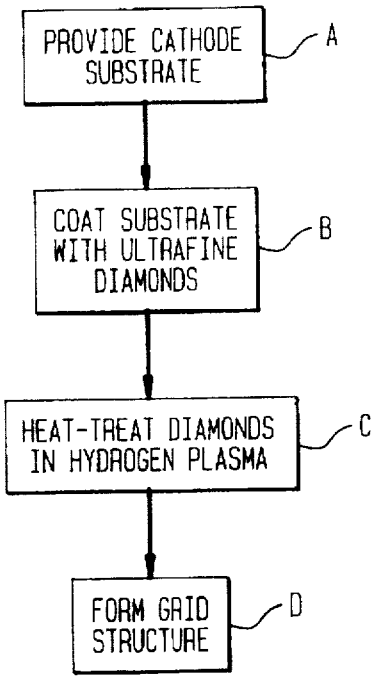
FIG. 3 is a flow diagram of a preferred process for ma king an electrode source incorporating activated ultrafine diamonds.

FIG. 3 is a schematic block diagram of the steps involved in making an electron source comprising activated ultrafine diamonds. As shown in block A, the first step in making an electron source is to provide a substrate which can be used as a cathode. The substrate typically comprises a conductive layer such as metal, conductive oxide or doped semiconductor. The conductive layer can be patterned, if desired, into rows or columns.

The next step (block B) is to coat the conductive surface with ultrafine diamonds. For low voltage field emitter structure, ultrafine diamond particles are desired not only because of the possible presence of emission voltage-lowering defects but also because of their small radii of curvature which tend to concentrate the electric field. Such ultrafine particles are typically in the range of 10 nm to 1,000 nm diameter, and preferably 10 nm to 300 nm diameter. Such ultrafine diamond particles can be obtained under the trade name Mypolex from E. I. Dupont Co., Wilmington, Del. Alternately they can be prepared by low pressure chemical vapor deposition, precipitation from supersaturated solution, or mechanical or shock-induced pulverization of large diamond particles.

The diamond particles are advantageously suspended in an aqueous solution or other suitable solvent (such as alcohol or acetone) in order to avoid agglomeration of fine particles and for easy application on flat substrate surfaces. The suspension allows thin and uniform coatings of diamond particles to be achieved in a convenient manner using any one of a number of low cost processing techniques such as spray coating, spin coating, sol gel coating or electrophoresis. The coating is desirably thin, with the thickness less than 10 μm, preferably less than 1 μm, and more preferably only one layer of particles.

Instead of suspension, the ultrafine diamond particles can also be mixed with conductive particles such as elemental metals or alloys like solder particles together with solvents and optionally binders (to be pyrolized later) to form a paste or slurry. In this case, the mixture can be screen printed or dispersed through a nozzle using the known techniques to form a desired emitter pattern. The solder (especially low melting solders such as Sn, In, Sn—In, Sn—Bi, or Pb—Sn) can be melted to further enhance the adhesion of the diamond particles and allow easy electrical conduction to the emitter tips. Alternatively, instead of applying suspension or paste, dry diamond particles can be placed on the surface of the conductor-covered substrate by electrophoresis or by sprinkling. The diamond particles are then secured either by physically embedding them into soft conductor layers or by chemically bonding onto the conductor.

Because of the ultrafine nature of the diamond particles, they provide many emitting points, typically more than $10^8$ emitting tips per square centimeter assuming 10% area coverage and 10% activated emitters from 100 nm sized diamond particles. The preferred emitter density in the invention is at least $10^4/cm^2$, preferably at least $10^5/cm^2$ and more preferably at least $10^6/cm^2$.

The third step in FIG. 3 (block C) is to activate the ultrafine diamond particles by heat treating them in plasma comprising hydrogen. The as-coated ultrafine diamond particles from the suspension are not good field emitters. It has been discovered by the inventors that a special plasma processing dramatically improve the electron emission characteristics of the diamond particles. Specifically, the coated ultrafine diamond particles are first dried in air at either room temperature or slightly elevated temperatures (<100° C.). Then they are loaded into a vacuum chamber for heat treatment in a plasma comprising hydrogen. The preferred plasma is a mixture of predominantly hydrogen and inert gas. The substrate temperature was typically kept above 400° C. and preferably above 500° C. for process kinetics and efficiency but preferably below 1,000° C. for convenience. The typical plasma parameters include a microwave power input of 1 kW and a pressure of 10–100 torr. The duration of a heat treatment is typically in the range of 1 min. to 100 hours and preferably 10 min. to 12 hours, depending on the temperature used. If an exposure to the high temperatures is not desirable, e.g., because of the presence of low melting point solder or low melting point glass, pre-activated diamond particles can be used so that the diamond particle emitters do not have to be plasma heat treated once they are deposited on the cathode.

The microwave plasma comprising hydrogen can also be replaced by a plasma or arc excited in hydrogen by means of radio frequency (rf) or direct current (dc). Other means of creating an activated source of atomic hydrogen such hot filaments of tungsten or tantalum heated to above 2,000° C., rf or dc plasma torch or jet, and combustion flame can also be utilized for heat treating the diamond coating. Alternatively, the ultrafine diamond particles can be activated in hydrogen plasma before they are adhered to the substrate conductor.

Figure 4:
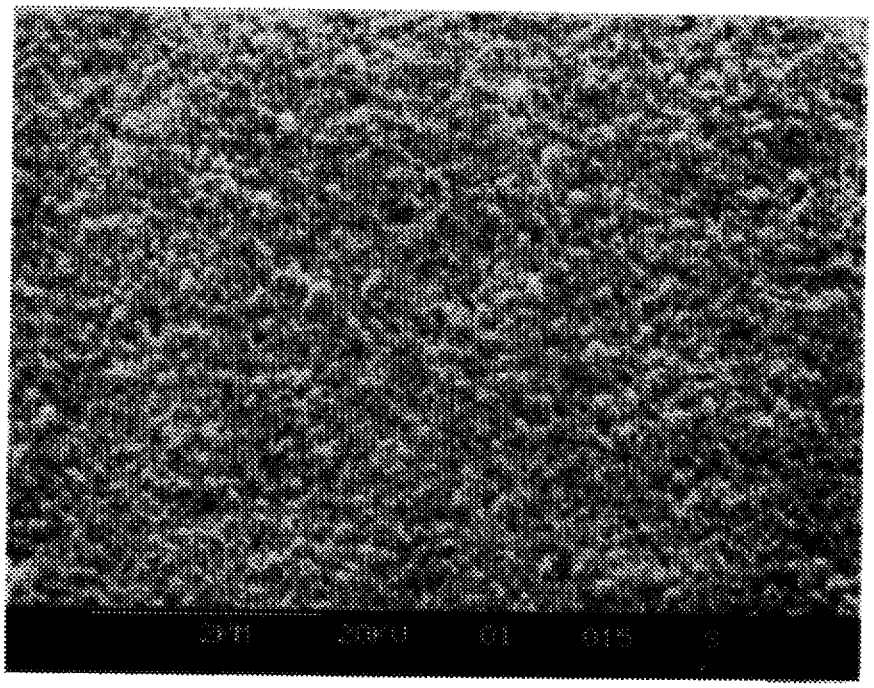
FIGS. 4 and 5 are SEM and TEM micrographs of ultrafine diamond cathode surfaces.
Figure 5:
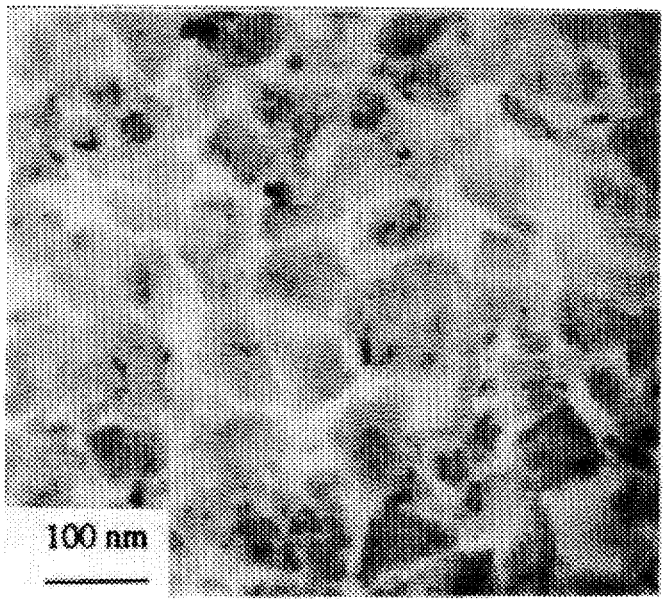

FIGS. 4 and 5 show both SEM and TEM micrographs of a plasma treated ultrafine diamond coating with particle sizes in the range of 50–100 nm.

Figure 6:
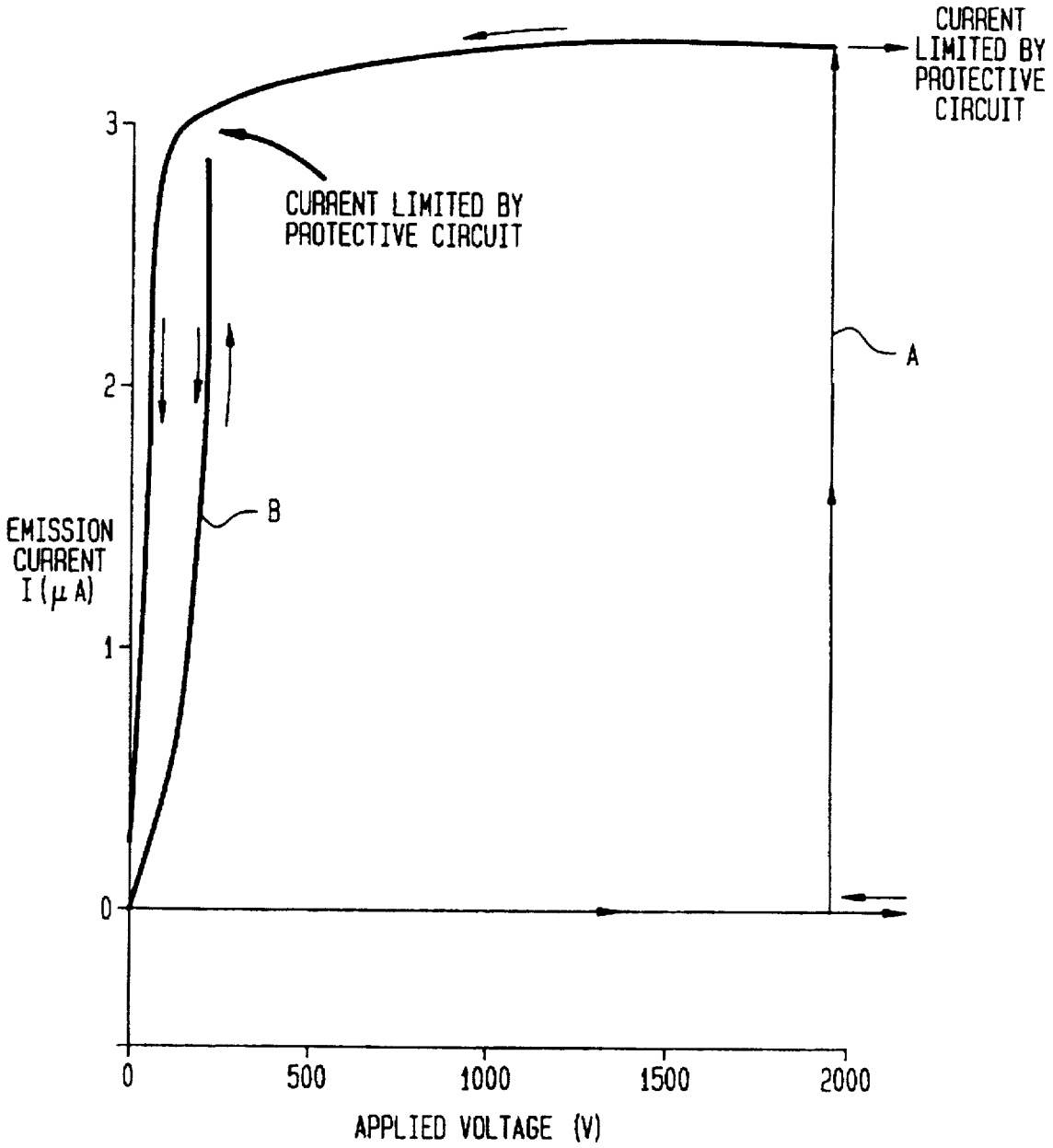
FIG. 6 illustrates emission current-voltage curves measured from diamond cathodes.

FIG. 6 shows experimentally measured emission I-V curves for activated and unactivated ultrafine diamonds. In the Figure, the voltage was cycled from zero to the maximum (+2,000V) and then decreased to zero. The unactivated ultrafine diamond (Curve A), showed no electron emission except an arc that formed when the anode probe was moved very close (3.3 μm in this case) to the diamond surface. This was indicative of an electrical breakdown of the surface under the intense electric field from the probe. Accompanying the arc, the surface of the diamond coating was damaged and craters were created by evaporation of the diamond. This electrical breakdown is believed to be due to the insulating nature of the diamond particles and poor contacts between particle and particle as well as between particle and substrate.

However, when the diamond coating was heat treated in a hydrogen plasma at 875° C. for 4 hours, a characteristic Fowler-Nordheim emission I-V curve was obtained (Curve B). The current varied smoothly and consistently with the voltage and in an approximately history-independent manner, indicating sufficient conductivity of the coating. Calculations of the field required to yield an emission current density of 0.1 mA/mm$^2$ based on curve fitting of the classic Fowler-Nordheim equation gave a value of 0.5 V/μm for this particular material. This represents a dramatic reduction of the field required for p-type diamond (typically 70 V/μm) and defective diamond (typically 10–20 V/μm). Emission curves from different locations of the same sample and from other similarly treated samples consistently yield a field between 0.5–1.5 V/μm for a current density of 10 mA/cm$^2$.

Surprisingly, the plasma treated surface of the ultrafine diamond coating was very stable. The emission characteristics which are insensitive to the exposure to air. When a sample was exposed to air for weeks and even months after the high temperature plasma treatment, it exhibited the same emission behavior just as a freshly plasma-treated diamond sample. This suggests that the plasma treated diamond surface is chemically inert. However, when the plasma-treated surface was subject to bombardment by energetic ions such as 400 eV hydrogen ions, the emission was essentially suppressed, and the diamond behaved like an untreated coating. It is believed that the ion bombardment damaged the features on the surfaces of the plasma heat-treated diamond particles which are responsible for the emission. These features possibly include the hydrogen termination of the carbon bonds, but the exact nature is not clearly understood. This suggests that a pattern of emission can be written by an ion beam.

While the exact role of the plasma heat treatment is not completely understood, it is believed that the hydrogen plasma cleans the diamond surface by removing carbonaceous and oxygen or nitrogen related contaminants and possibly produces a hydrogen-terminated diamond surface with low or negative electron affinity. The hydrogen plasma also removes any graphitic or amorphous carbon phases present on the surface and along the grain boundaries. In addition, the treatment improves contacts among the particles and between the particles and the substrate through diffusional bonding (e.g., formation of carbide interface), thus increasing the bulk as well as the surface conductivity. Such conductive contacts sustain a stable electron emission process. The structure of the ultrafine diamond particles is believed to be defective, containing various types of bulk structural defects such as vacancies, dislocations, stacking faults, twins and graphitic or amorphous carbon phases. When the concentrations of these defects are high, they can form energy bands within the bandgap of diamond and thus facilitate the electron emission.

Since efficient electron emission at low applied voltages is typically achieved by the presence of accelerating gate electrode in close proximity (typically about 1–10 micron distance), it is desirable to have multiple gate aperture over a given emitter body to maximally utilize the capability of multiple emitters. It is desirable to have a fine-scale, micron-sized gate structure with as many gate apertures as possible for maximum emission efficiency.

Accordingly, the next step shown in block D of FIG. 3 is to add a grid structure in front of the ultrafine diamond cathode. The grid is a conductive element placed between the electron emitting cathode and the anode. It is separated from the cathode but sufficiently close to the diamonds to excite emissions (typically within 10 μm of the diamonds). The grid can be separated from the cathode by an electrically insulating layer such as aluminum oxide. The grid structure in the present invention desirably consists of a layer of thin film or thin foil conductor material with many apertures. Within each aperture area, a multiplicity of ultrafine diamond particles emit electrons when a field is applied between the cathode and the grid. A more positive voltage is applied to the anode in order to accelerate and impart a relatively high energy to the emitted electrons.

The desired dimension of the grid apertures is in the range of 0.05–100 μm in average diameter. It is preferably at least 0.1 μm, and more preferably at least 0.2 μm for ease of manufacturing. The maximum aperture size is preferably at most 20 μm, and even more preferably at most 5 μm for the sake of 1) increasing the density of grid apertures, 2) maximizing the number of activated diamond particle emitters within each aperture area, and 3) reducing the angular beam spread. The shape of the grid aperture can be circular or irregular in shape. The desired thickness of the grid conductor is in the range of 0.05–100 μm and preferably 0.1–10 μm. The grid conductor material is typically chosen from metals such as Cu, Cr, Ni, Nb, Mo, W or alloys thereof, but the use of highly conductive oxides, nitrides, carbides, etc. is not prohibited. The apertured (or perforated) grid structure can be prepared by conventional thin film deposition and photolithographic etching.

Advantageously the grid is a high density apertured gate structure such as described in Jin et al. co-pending application Ser. No. 08/229,674 filed Aug. 31, 1994 which is incorporated herein by reference. The combination of ultrafine diamond emitters with a high density gate aperture structure is particularly desirable with submicron emitters. Such a high density gate aperture structure can be conveniently achieved by utilizing micron or submicron sized particle masks. After activated ultrafine diamond particle emitters are adhered to the conductive cathode surface, mask particles (metal, ceramic, or plastic particles typically having maximum dimensions less than 5 μm and preferably less than 1 μm) are applied to the diamond emitter surface as by spraying or sprinkling. A dielectric film layer such as $SiO_2$ or glass is deposited over the mask particles as by evaporation or sputtering. A conductive layer such as Cu or Cr is deposited on the dielectric. Because of the shadow effect, the emitter areas underneath each mask particle have no dielectric film. The mask particles are then easily brushed or blown away, leaving a gate electrode having a high density of apertures.

Figure 7A:
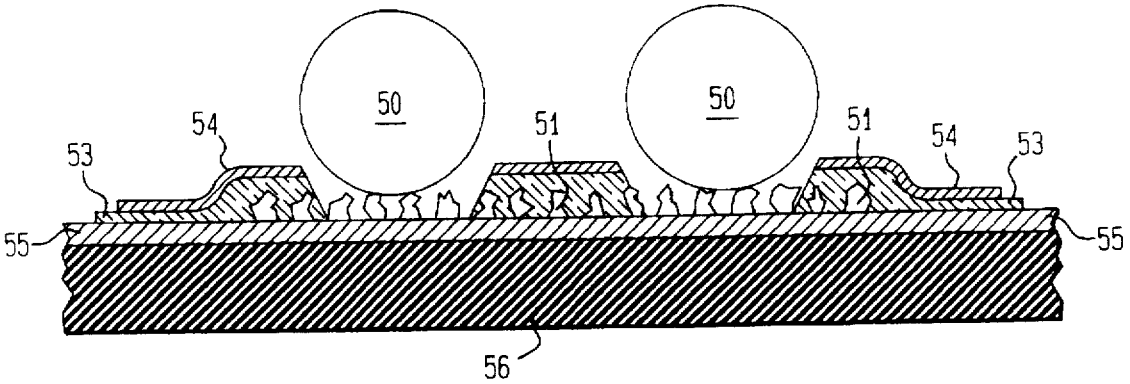
FIG. 7A is a cross-sectional diagram of an exemplary diamond cathode according to the invention.
Figure 7B:
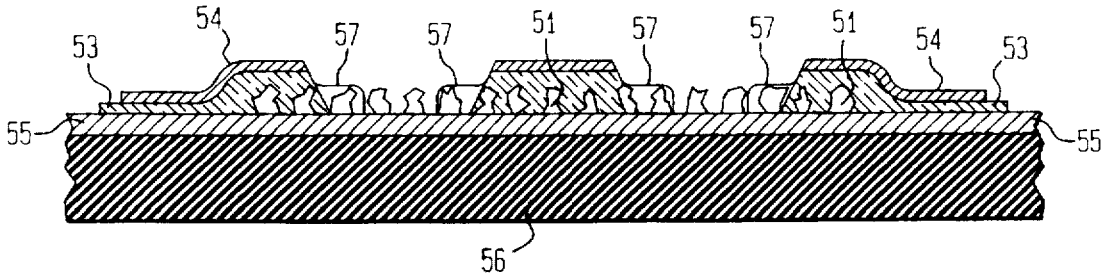
FIG. 7B is a cross-sectional diagram of the exemplary diamond cathode of FIG. 7A showing an optional non-emissive overlayer on the diamond emitters.

FIG. 7 is a schematic cross section of an exemplary grid-aperture structure being prepared by the particle mask technique. The particle mask 50 above the ultrafine diamonds emitters 51 blocks the deposition of the insulating layer 53, and the grid conductor layer 54 on the emitter particles 51 adheres onto conductor 55 on substrate 56. When the mask particles 50 are brushed away, the apertures (or perforations) are opened to allow electrons to pass through.

This completes the fabrication of the improved electron source which can then be incorporated into a microwave tube device in the conventional manner producing a device with the advantages described above.

III. Multilayer Grid Structure

We now describe a particular embodiment of an electron source which is particularly useful in microwave tube devices which require a beam of electrons.

One of the anticipated problems in using cold cathode field emitters for microwave amplifiers requiring electron beams is the beam spreading during the electron travel to the anode. Electrons emerge from the cathode surface with a Maxwellian distribution of velocity in all three Cartesian directions. In other words, electrons will emerge from the surface with, in general, nonzero velocity and at various angles to the surface normal. The field-emitted electrons thus have a distribution in the direction of electron beam trajectory. These effects—1) random emission of electrons, 2) undesirable momentum perpendicular to the path from the cathode to the anode and 3) the resulting crossing of electron trajectories on the microscopic scale—all reduce the performance of the microwave amplifier by giving rise to shot noise as well as the minimum diameter that a convergent beam can attain. It is, therefore, desirable that the electron beams from different apertures in the grid not merge unless the electron beams from each aperture are nearly parallel. Should the beams merge while individually diverging, the phase space density of the resultant beam will be lowered, as at any given point, electrons can be found with a variety of different momenta.

The divergence angle of the electrons from each aperture can be reduced by creating an electrostatic lens in the aperture. However, Liouville's Theorem (C.F. Classical Dynamics of Particles and Systems, J. Marion, Academic Press, New York, 1970, LCCN 78-107545, pp. 229–233) constrains the extent to which a lens can reduce the perpendicular momentum spread. If the emitting area is equal to the lens aperture, then no substantial improvement can be obtained. If the emitting area is smaller than the lens aperture, the perpendicular momentum distribution can be reduced (with proper lens design) by the ratio of the radius of the emitting area to the radius of the lens.

It is thus desirable to allow emission only from small spots near the center of each aperture, i.e. at most 70% of the area and preferably at most 50% of the area. This can be accomplished by patterning the substrate so that for a plurality of the emitting apertures only a small area (smaller than the aperture area) is electrically conductive. It can also be accomplished by controlling ultrafine diamond deposition or processing so that only the central area is activated and emits. This can be accomplished by depositing a non-emissive overlayer 57 on the diamond emitters everywhere but at the center of the apertures as depected in FIG. 7B, or by ion bombarding diamonds in the peripheral regions is that only the central regions emit.

The preferred technique for reducing the divergence angle, however, is to use a multilayer grid and to operate a first grid at a negative potential relative to the cathode. This first grid is typically 0.01 to 2 of its mean aperture radius above the cathode, and preferably 0.01 to 1 of its mean aperture radius above the cathode. This first grid reduces the electric field at the cathode surface, near the edge of the hole, and thus surpresses emission preferentially from the edge. Other grids would typically be at voltages positive relative to the cathode.

Figure 8:
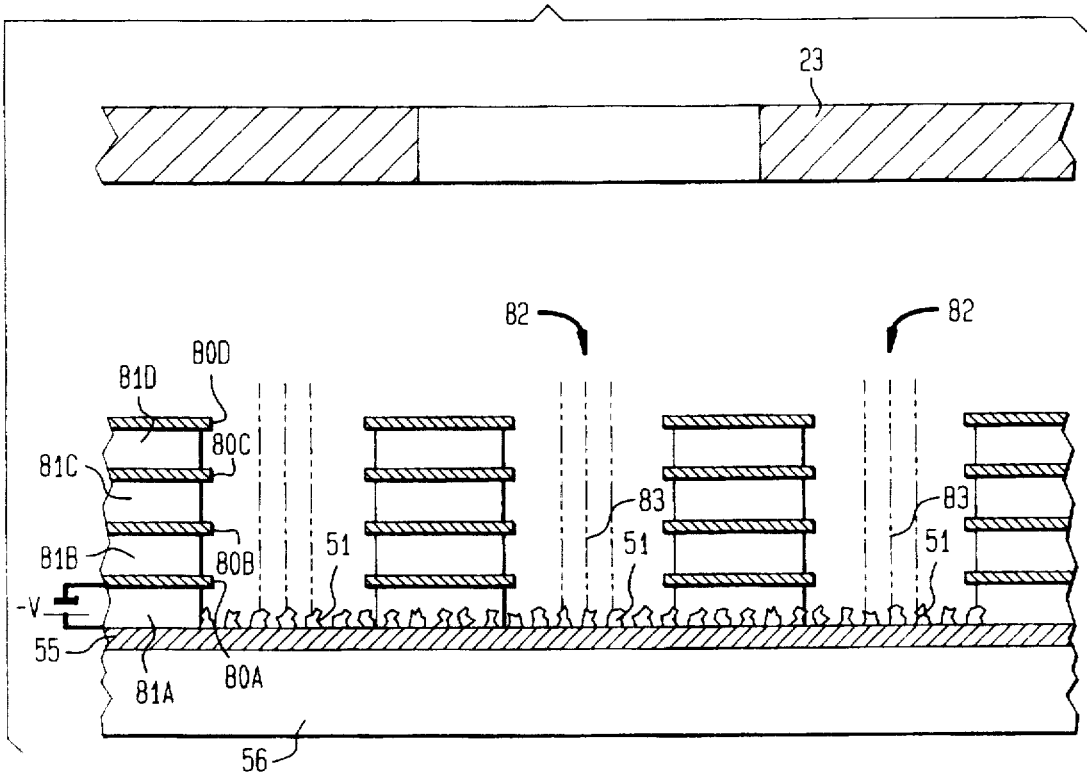
FIG. 8 is the multiple grid structure designed for extracting, accelerating and focusing an electron beam from a diamond cathode surface.

As schematically illustrated in FIG. 8, the multilayer grid structure has at least two layers and preferably at least 4 layers of grid conductors 80A, 80B, 80C, 80D separated by insulators 81A, 81B, 81C, 81D and with aligned apertures 82. The grid conductors allow the electron beams 83 to be focused during traveling. The first grid layer closest to the emitters (80A) can be biased negative in order to reduce the perpendicular momentum through suppression of field emission near the edge of the grid apertures. The multilayered grid structure can be prepared by conventional thin film deposition and photolithographic techniques.

Figure 9:
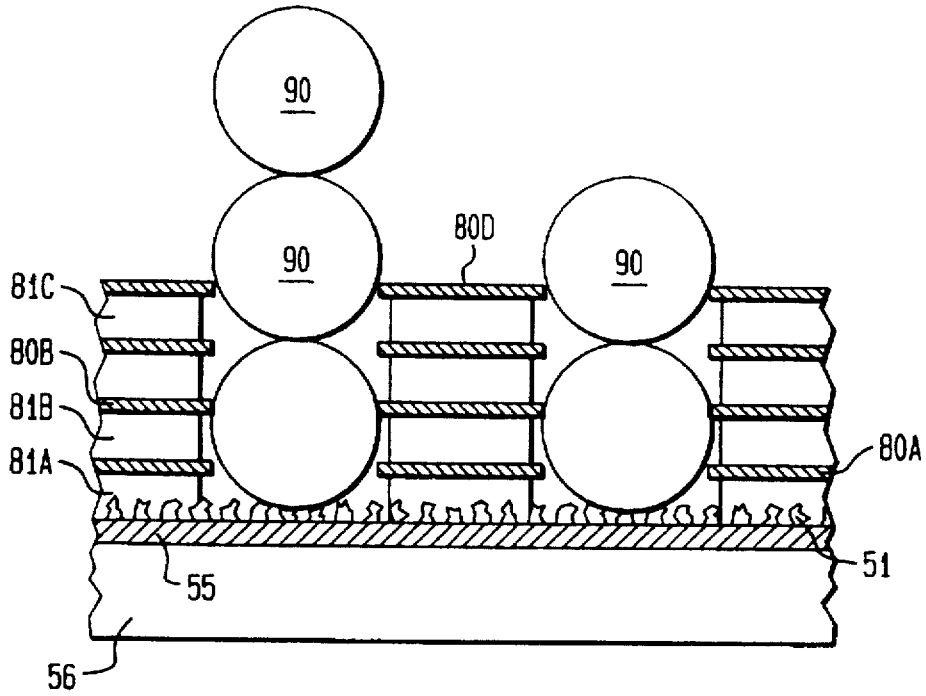
FIG. 9 schematically illustrates the preparation of a multilayer grid structure using magnetic mask particle stacks.
Figure 10:
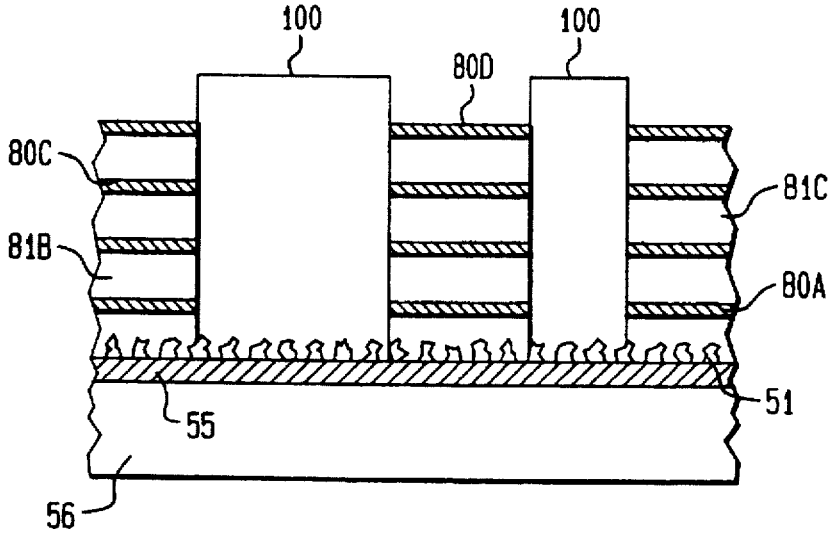
FIG. 10 schematically illustrates the preparation of a multilayer grid using elongated mask particles.

Alternatively, for ease of manufacturability and low cost, the multilayer grid structure can be fabricated by the particle mask technique disclosed in the aforementioned Jin et al. application Ser. No. 08/229,674. FIGS. 9 and 10 illustrate the structure being made.

In FIG. 9, the mask particles 90 are chosen to be ferromagnetic (e.g. Fe, Ni, Co, or their alloys). Desirable particle size is typically in the range of 0.1–20 μm in average diameter. During the placement of the particles, e.g. by sprinkling onto the ultrafine diamonds emitters, a vertical magnetic field is applied, which causes the ferromagnetic particles to form a vertically elongated chain-of-spheres containing at least 2 particles. Some chains-of-spheres may have more particles than others, but this does not matter for the purpose of depositing the multilayer grid structure. After alternating deposition of insulating spacer film and the grid conductor film into multilayer stacks, the ferromagnetic particles are removed either by magnetically plucking away, as by using a permanent magnet, or by chemical etching.

An alternative approach to making the multilayered grid structure is schematically illustrated in FIG. 10. Here, elongated or prolate ferromagnetic particles 100 are sprinkled in the presence of vertical magnetic field so that they stand up vertically to serve as mask particles during the deposition of the multilayer grid structure. The particle mask can then be removed either magnetically or by chemical etching. The elongated particle mask, with a preferred diameter in the range of 0.1–20 μm, can alternatively be prepared by thin film deposition (e.g. by sputtering, evaporation, electroless plating) of the mask material through a perforated template (not shown) placed at a desired height above the ultrafine diamond emitters. Suitable materials to be deposited as elongated mask particles include metals such as Cu, Al, Ni, or easily water or solvent dissolvable polymer (e.g. polyvinyl acetate, polyvinyl alcohol, polyacrylamide, acrylonitrile-butadiene-styrene or ABS), volatile polymer (e.g. PMMA), or easily dissolvable salt (e.g. NaCl). After deposition of these materials, the template is removed, the multilayer grid structure of FIGS. 8–10 is deposited. The elongated mask particles are then removed to expose the ultrafine diamond emitters.

The cathode and gate structure in the microwave amplifiers does not have to be flat in surface geometry. They can be prepared on a curved substrate (see FIG. 2), preferably concave in order to have some beam focusing effect. The curved substrate can be prepared by etching or mechanical polishing (e.g. Si) or by plastic deformation in the case of ductile metals (e.g. Mo, Nb, W, Fe, Ni, or alloys).

In preferred use the ultrafine diamond coated cathode and multilayer grid structure of FIG. 8 are substituted for the thermionic emission cathode of a conventional TWT. The TWT operates, as described in connection with FIG. 1, with the added advantages produced by the improved electron source. Ideally the cathode/grid structure is slightly concave for focusing the emitted electrons into a beam.

In the preferred electron source, four specific design improvements reduce the perpendicular momentum spread of electrons emitting from the cathode. (1) Low voltage emission is desirable to have minimal beam spreading. If the emitter geometry is held constant, the perpendicular momentum spread scales as the square root of the emission voltage. The use of ultrafine diamond emitters allows low voltage emission and hence reduced perpendicular momentum in microwave amplifier operation. (2) Electron emission is restricted to the central area portion, much smaller than the grid aperture area. (3) The electron beam is focused by a stack of multilayer grid structure, and (4) a concave substrate can be used to further focus the electron beam.

While specific embodiments of the present invention are shown and described in this application,. the invention is not limited to the particular embodiments described above. For example, the ultrafine diamond cathode can also be used in the construction of klystron, gridded tube, cross-field amplifier and gyrotron. Thus numerous embodiments and modifications can be made which do not depart from the scope of this invention.

What is claimed:

1. In a microwave vacuum tube device comprising an evacuated tube having an input window for the introduction of a microwave input signal, a source of electrons, an interaction structure for enhancing interaction between said input signal and electrons from said source, and an output window for permitting the output of a microwave signal derived from said electrons, the improvement wherein:

said electron source comprises a cathode comprising ultrafine diamond emitter particles predominantly in the range 10 nm to 1000 nm in diameter, said diamond particles being heat-treated in a plasma comprising hydrogen for producing, without heating, electron emission current density of 10 mA/cm$^2$ at electric fields of 10V/micrometer or less.

2. A device according to claim 1 wherein said range of ultrafine diamond emitter particles is between 10 nm and 300 nm in diameter.

3. A device according to claim 1 wherein said ultrafine diamond particles form a coating on said cathode having a thickness less than 10 μm.

4. A device according to claim 1 wherein said ultrafine diamond particles form a coating on said cathode having a thickness less than 1 μm.

5. A device according to claim 1 wherein the density of said diamond particles on said cathode is in excess of $10^4$/cm$^2$.

6. A device according to claim 1 wherein the density of said diamond particles on said cathode is in excess of $10^6$/cm$^2$.

7. A device according to claim 1 wherein said ultrafine diamond particles are heat treated in a plasma comprising hydrogen at a temperature in excess of 400° C. for a period of 1 min. to 100 hours.

8. A device according to claim 1 wherein said ultrafine diamond particles are heat treated in a plasma comprising hydrogen at a temperature in the range 500° C.–1000° C. for a period of 10 min. to 12 hours.

9. A device according to claim 1 further comprising a conductive grid having a plurality of apertures, said grid insulated from said cathode and disposed within 10 μm of said cathode.

10. A device according to claim 9 wherein electron emission from a plurality of apertures is confined to the central regions of said apertures, with emission from at most 70% of the cathode areas exposed by said apertures.

11. A device according to claim 9 wherein electron emission from a plurality of apertures is confined to the central regions of said apertures, with emission from at most 50% of the cathode areas exposed by said apertures.

12. A device according to claim 9 wherein electron emission from a plurality of apertures is confined to the central regions of said apertures by a non-emitting overlayer.

13. A device according to claim 9 wherein electron emission from a plurality of apertures is confined to the central regions of said apertures by ion bombardment.

14. A device according to claim 9 wherein said grid comprises a conductive layer having apertures in the range 0.05–100 μm average diameter.

15. A device according to claim 9 wherein said grid comprises a conductive layer having apertures in the range 0.1 μm–20 μm average diameter.

16. A device according to claim 9 wherein said grid comprises a conductive layer having apertures in the range 0.2 μm–5 μm average diameter.

17. A device according to claim 9 wherein said grid has a thickness in the range 0.10–10 μm.

18. A device according to claim 9 wherein said grid has a mean aperture radius and is disposed away from said cathode by a distance 0.01 to 2 of its mean aperture radius.

19. A device according to claim 9 wherein said grid has a mean aperture radius and is disposed away from said cathode by a distance 0.01 to 1 of its mean aperture radius.

20. A device according to claim 1 comprising a plurality of successive grid conductors insulated from said cathode and from each other.

21. A device according to claim 20 wherein said successive grid conductors have aligned apertures.

22. A device according to claim 21 wherein said conductive layer is concave for focusing emitted electrons into a beam.

23. A device according to claim 20 wherein the grid of said plurality nearest said cathode is operated at negative potential.

24. A device according to claim 1 wherein said interaction structure comprises a helix.

25. A device according to claim 1 wherein said interaction structure comprises coupled cavities.

26. A device according to claim 1 wherein said microwave vacuum tube device comprises a traveling wave tube microwave amplifier.

* * * * *